343-754 SR

12/11/84 OR 4,488,156

United States Patent [19]

DuFort et al.

[11] Patent Number: 4,488,156

[45] Date of Patent: Dec. 11, 1984

[54] GEODESIC DOME-LENS ANTENNA

[75] Inventors: Edward C. DuFort; Harold A. Uyeda, both of Fullerton, Calif.

[73] Assignee: Hughes Aircraft Company, El Segundo, Calif.

[21] Appl. No.: 347,666

[22] Filed: Feb. 10, 1982

[51] Int. Cl.[3] ..... H01Q 19/06; H01Q 15/04

[52] U.S. Cl. ..... 343/754; 343/909

[58] Field of Search ..... 343/911 R, 911 L, 754, 343/783, 753, 772, 780, 786, 909

[56] References Cited

U.S. PATENT DOCUMENTS

| | | | |
|---|---|---|---|
| 2,599,896 | 6/1952 | Clark et al. | 343/783 |
| 2,669,657 | 2/1954 | Cutler | 343/911 R |
| 2,795,783 | 6/1957 | Dunbar | 343/754 |
| 2,814,037 | 11/1957 | Warren et al. | 343/754 |
| 2,822,541 | 2/1958 | Sichak et al. | 343/783 |
| 3,116,485 | 12/1963 | Carson | 343/754 |
| 3,255,453 | 6/1966 | Horst | 343/754 |
| 3,343,171 | 9/1967 | Goodman | 343/754 |
| 3,487,413 | 12/1969 | Shores | 343/754 |
| 3,697,998 | 10/1972 | Schaufelberger | 343/754 |
| 4,114,162 | 9/1978 | Wild | 343/754 |
| 4,146,895 | 3/1979 | Wild | 343/754 |
| 4,361,841 | 11/1982 | Cassel et al. | 343/911 L |

FOREIGN PATENT DOCUMENTS

| | | | |
|---|---|---|---|
| 2005452 | 8/1971 | Fed. Rep. of Germany . | |
| 1766019 | 3/1972 | Fed. Rep. of Germany . | |
| 876304 | 8/1961 | United Kingdom | 343/754 |
| 1166105 | 10/1966 | United Kingdom . | |

OTHER PUBLICATIONS

Johnson, "The Geodesic Luneberg Lens", The Microwave Journal, Aug. 1962, pp. 76–85.

Rinehart, "A Solution of the Problem of Rapid Scanning for Radar Antennas", Journal of Applied Physics, vol. 19, Sep. 1948, pp. 860–862.

Hollis, Long, "A Luneberg Lens Scanning System", IRE Transactions on Antennas and Propagation, Jan. 1957, pp. 21–25.

*Primary Examiner*—Eli Lieberman

*Assistant Examiner*—Michael C. Wimer

*Attorney, Agent, or Firm*—Thomas A. Runk; A. W. Karambelas

[57] ABSTRACT

An antenna of the geodesic lens type is disclosed. The antenna structure is based on optical principles and provides wide angle scanning of a narrow base. The exact shape of the domed structure is found by solving an integral equation and results in nearly perfect focus in the scan plane. A dielectric loaded flared horn is attached to the feed circle of the domed structure and focusses energy in the plane orthogonal to the scan plane. The cross sectional shape of the outer curvature of the dielectric is elliptical. Since the structure is circularly symmetrical, constant beam shape, wide angle scanning, and a rapid scan rate are possible.

11 Claims, 6 Drawing Figures

GEODESIC DOME-LENS ANTENNA

BACKGROUND OF THE INVENTION

This invention relates to the field of antennas, and more particularly to a geodesic lens antenna for use in scanning.

Scanning for radiating emitters or reflecting objects can be a difficult and time-consuming procedure. Frequently, signals are not received because they are radiated for only a very short time period and reception equipment is not responsive enough to detect such signals. A further problem arises where the receiving equipment does not have the bandwidth necessary to detect signals of widely differing frequency. Thus, considerations involved in constructing an antenna system usable to detect radiating emitters and reflecting objects include a wide scanning angle to scan as large an area as possible, a rapid scan rate to receive short duration emissions, a wide frequency range to detect as wide a range of emitters as possible, low internal losses in order to detect low level signals, constant high performance and constant beam shape over the complete scan angle in order to maintain a consistently high probability of detection over the entire scan angle. These considerations are discussed in relation to the invention in the following paragraphs.

In a radar application or in an application where the antenna is involved in only a "listening" mode, constant beam shape and constant performance over the whole scanned area is desirable in order to detect an unexpected object and to accurately map its location. There is no particular azimuth angle where best performance is preferred since unexpected objects may appear anywhere. Thus, the ability to rapidly scan a beam of constant shape over as wide an azimuth angle as possible is highly desirable.

The ability to receive and process signals over a wide frequency range is also desirable. Since the antenna is the first apparatus in the chain of received signal processing equipment, the bandwidth of the antenna can restrict the system bandwidth. Thus, an antenna with as wide a frequency range of reception as possible is desirable in order to increase the probability of detection of objects of unknown frequency. Problems in bandwidth are particularly noticeable in prior art antenna systems which use microwave circuit techniques including power dividers, couplers, hybrid devices, etc. and constrained transmission lines. In order to have a broadband antenna system each element, junction and interface must be electrically matched and must be individually broadband. As is well known to those skilled in the art, designing a broadband antenna while employing such devices and constrained transmission line can be extremely difficult due to the differing and interacting electrical properties of each element.

As stated previously, a further consideration in the detection and tracking of objects is the inherent losses of the antenna system. In order to detect low level signals, a relatively efficient and low loss antenna is required so that the signal will not be dissipated by the antenna apparatus before it reaches the remaining signal processing equipment. Prior art systems which use constrained techniques, microwave devices, junctions, and high loss dielectrics dissipate a sometimes unacceptable amount of signal due to inherent losses. Examples of such losses are insertion losses, losses due to device interactions and standing waves caused by various interfaces. Thus the designer of a low loss antenna faces many of the same problems as the designer of a wide bandwidth antenna.

In relation to scan speed, prior art systems which operate at K-band frequencies include mechanically steerable, narrow beam antennas which may be computer-controlled. Since the antenna beam is scanned by the mechanical motion of the antenna, the scan rate is relatively slow and consequently the probability of detection of a short duration signal is relatively low.

Another prior art system is the phased array antenna. The scan rate in this system is higher than the mechanical systems due to computer control and electronic steering. However, the bandwidth of a phased array system is relatively narrow and the beamwidth changes with the scan angle. In addition, the phased array system is frequency sensitive in that the beam position will shift with a frequency change. While a phased array antenna system can be used to listen to a wide angle sector without a scanning action, the bandwidth in this operational mode is even narrower than in the scanning mode. Therefore, both of these prior art systems realize relatively poor performance in wide angle listening and scanning operations.

Antennas designed on the basis of optical principles have been more successful in satisfying the requirements for a rapid scanning antenna. In an optical system, energy propagation is determined by the laws of geometrical optics and so octave bandwidths and operation in the millimeter wavelength region are more easily attainable. Propagation is in accordance with ray angles or path lengths along rays which is independent of the operating frequency. Signal dissipation is low since air filled, unconstrained transmission paths may be used. A prior art system based on optical techniques is the Rinehart antenna. This type of antenna is well known in the art for having the ability to scan theoretically perfectly.

The Rinehart antenna is a configuration type antenna structure and is specifically described in the following publication; R. F. Rinehart, *A Solution of the Problem of Rapid Scanning for Radar Antennae,* Journal of Applied Physics, Vol. 19, September 1948. As can be noted, Rinehart's antenna is the open waveguide analog of a variable dielectric Luneberg lens. There are two parallel conducting elements which are configured in a dome-like shape. It is thought by those skilled in the art that energy which traverses the area between the two elements follows an arithmetic mean surface between them. Thus the objective of shaping the two conducting elements is to form this arithmetic mean surface such that when energy is introduced between the two conducting elements from a point source on their periphery, energy will emerge from this structure diametrically opposite to the point source and will take the form of a collimated beam. Likewise, energy from the external environment which is in the form of a collimated beam and which strikes the Rinehart antenna will be focussed at a point on the periphery diametrically opposite the line tangent to the antenna and normal to the collimated beam.

A basic theory upon which the operation of Rinehart's antenna and other geodesic antennas are based is Fermat's least time principle; that is, electromagnetic energy is propagated along geodesics on the arithmetic mean surface which is formed between parallel conducting plates. Thus, Rinehart's antenna changes path lengths by configuring the arithmetic mean surface into a dome-like shape so that there are paths of equal length from a point on the periphery of the antenna to all points on a line tangent to the periphery and located diametrically opposite the point. The Rinehart antenna has theoretically perfect scanning properties, however, the direction of flow at the periphery is parallel to the central axis about which the dome-like elements are revolved. The desired direction of flow is in the plane normal to the axis such that a wide area may be scanned. Thus, an efficient reflector or lip is required at the periphery which will direct the energy but which will not create prohibitively large reflections or defocus that energy. A method to achieve this result is found in U.S. Pat. No. 2,814,037 entitled "Scan Antenna" to Warren et al.

The Warren et al. patent concerns a modification of the Rinehart antenna. This modification purportedly directs the energy at an angle to the central axis, in an outward direction. In order to retain the theoretically perfect focussing property in the scan plane in accordance with the Rinehart theory, Warren et al. has reshaped the geodesic dome to accommodate the lip that was added. The resulting antenna has a narrow beam in azimuth which is scanable over a wide azimuth angle, however, there is a relatively broad beam in elevation. The terms azimuth and elevation are used herein in accordance with their meanings as are well defined in the art, azimuth refers to angular position in a horizontal plane and elevation refers to angular position in a vertical plane. However, it is to be understood that the terms are relative and are merely used to establish reference planes in order to make visualization of antenna operation somewhat easier.

A broad beam width in elevation is an undesirable property in certain applications. For example, in many object detection and tracking applications, a narrow to moderate beamwidth in both azimuth and elevation is desirable. This narrower beamwidth has beneficial effects, one of which is the capability to scan a greater distance due to energy concentration. Prior art geodesic antennas disclose a means of focusing or compressing the beam in elevation through the use of parabolic reflectors, reflector feed assemblies, and parabolic-cylinder reflectors. An example of such an apparatus is found in U.S. Pat. No. 3,343,171 entitled "Geodesic Lens Scanning Antenna" to Goodman.

The Goodman patent purportedly achieves a compressed vertical beamwidth through the use of reflectors. However, several substantial disadvantages exist with this method of achieving vertical directivity. The first is that the reflecting apparatus required is commonly larger than the geodesic antenna dome thereby making the total antenna apparatus a large mass and subject to various physical interferences such as wind impact. Secondly, there is poor aperture efficiency due to the relatively large size of the reflector and the fact that the entire reflector is not illuminated for all beams. Thirdly, the apparatus is not circularly symmetrical due to the use of a reflector therefore the beamwidth will change with scan angle and several reflectors will be required for large azimuthal coverage.

Thus, even though antenna systems based upon optical principles exist in prior art, the deficiencies of these prior art systems result in relatively poor performance in wide angle scanning or listening applications.

SUMMARY OF THE INVENTION

Accordingly, it is a purpose of this invention to provide a new and improved scanning antenna which overcomes most, if not all, of the above-identified disadvantages of prior art antennas.

It is another purpose of the invention to provide an antenna which is capable of rapid wide angle scanning one plane while maintaining a constantly shaped beam in the orthogonal plane.

It is another purpose of the invention to provide a geodesic lens antenna which has a narrow to moderate beamwidth in the plane orthognoal to the scan plane.

It is another purpose of the invention to provide an antenna which is capable of high aperture efficiency, has a wide bandwidth, and can operate at any microwave frequency including millimeter wavelengths.

It is another purpose of the invention to provide a geodesic lens antenna which is mechanically stronger, simpler, smaller and more easily manufactured than prior art geodesic lens antennas.

The above purposes and advantages are accomplished in accordance with the present invention by the provision of a geodesic lens scanning antenna having two concentric dome-shaped conductors, both of which are connected at their circular peripheries to a dielectric filled flared waveguide horn. The two concentric conductors act as a TEM waveguide and the phase velocity is independent of the frequency of operation. These conductors are figures of revolution about an axis through their centers and their exact shape is unique.

The term "dome" is used herein in reference to the shape of these conductors however the term is used only for convenience and is not applied herein in a definitive or restrictive sense. The exact shape of the conductors is dependent upon various parameters as will be discussed herein. In general the shape will resemble what is commonly known as a "dome" and so that term is used.

The flared horn is annular and affixed to the periphery of these conductors and is disposed in a particular relationship to the above mentioned axis in order to confine the beam in the elevation plane. The circular periphery of these concentric conductors is commonly referred to as the feed circle since it is the area where energy may enter or leave the area between the conductors. The amount of feed circle to which this flared horn is affixed is proportional to the scan angle of the antenna. One plate of the flared horn is directly affixed to the periphery of the outer concentric conductor. The remaining plate of the flared horn is attached to a "matched 90° bend" which is part of the inner concentric conductor's periphery. This matched bend redirects energy in order to transition the direction of the flared horn to the axial direction of the path at the periphery of the two concentric conductors. The dielectric which is fitted inside the flared horn has a specific cross sectional shape such that energy passing through it will be focussed in elevation. In this embodiment, the part of the feed circle of the concentric conductors which is not affixed to the flared horn may be connected to a means of feeding energy into or out of the area between the conductors. Means commonly employed is a rigid rectangular waveguide.

As was noted previously, prior art geodesic lens antennas are capable of theoretically perfectly scanning a narrow beam in the scan plane but have a broad beam in the orthogonal plane. In order to narrow the beamwidth in the orthogonal plane, the invention uses the dielectric filled flared waveguide feed horn. The horn is a circularly symmetrical E-plane horn. The size of the horn is dependent upon wavelength and beamwidth requirements. The type of dielectric fitted inside the horn also affects the horn size. Although this flared horn now focusses energy in the orthogonal plane, it precludes the prior art geodesic lens antennas from focussing in the scan plane since the path lengths have been altered.

A new dome shape which takes the effects of the flared horn into account has been derived and is used in constructing the concentric conductors of the invention. With this unique dome shape and the attachment of the dielectric filled flared horn, the invention is capable of scanning a narrow beam in the scan plane and a moderate to narrow beam in the orthogonal plane. Since the invention is circularly symmetrical, wide angle scanning of a constantly shaped beam is possible. Due to the use of Fermat's principle in formulating the shape of the concentric conductors in accordance with the invention, the rays in the scan plane are focussed and so the beamwidth is narrow. The beamwidth in the orthogonal plane is narrow to moderate due to the use of the flared horn and dielectric which acts as a focussing lens. Since this lens is likewise circularly symmetrical about the axis through the concentric conductors, the beam shape is constant through the complete scan angle.

Thus the invention achieves scan plane and orthogonal plane directivity without the use of bulky prior art parabolic reflectors and other such devices. No mechanical motion is required to scan due to the circular symmetry of the invention and so rapid scanning by electronic switching or other means is possible. Furthermore a sector of space may be monitored or "listened to" without a scan action by connecting receiving apparatus to various points on the feed circle. By comparing the energy focussed at these various points, the location of a detected object in the sector can be determined.

The invention is composed of few parts and so is simpler than prior art systems. The parts used may be built with loose tolerances and readily available materials. Thus the invention is easier to fabricate and is generally less expensive than prior art systems. The novel features which are believed to be characteristic of the invention, both as to its structure and method of operation together with further objects and advantages thereof will be better understood from the following descriptions considered in connection with the accompanying drawings.

DETAILED DESCRIPTION OF THE INVENTION

Figure 1:
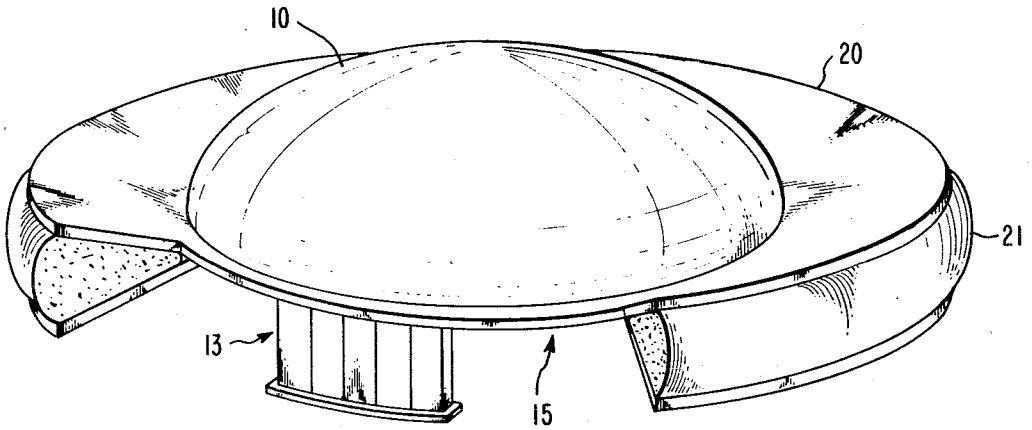
FIG. 1 is a perspective view of a geodesic dome/lens antenna in accordance with the subject invention.

In FIGS. 1, 2, 3, 4, 5 and 6 there is shown a geodesic/-dome lens antenna. The preferred embodiment as depicted in these figures comprises two dome-shaped concentric conductors 10 and 11, a mitered bend 12 disposed on the inner dome-shaped conductor 11, and metallic flared horn 20 which is filled with a dielectric substance 21.

Figure 2:
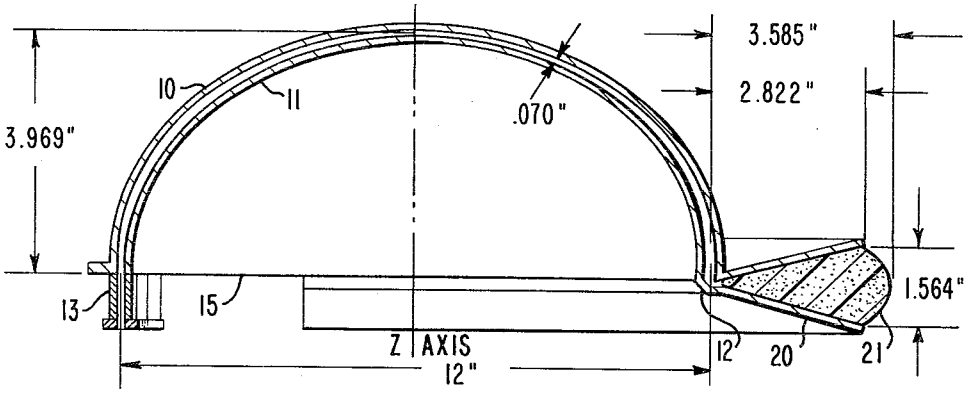
FIG. 2 is a cross-sectional side view of an embodiment of the subject invention.
Figure 6:
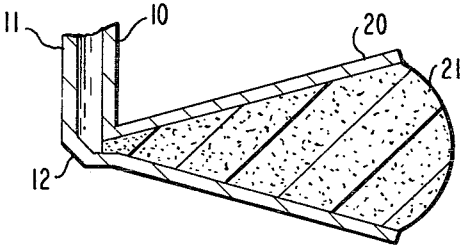
FIG. 6 is a cross-sectional side view of an embodiment of the subject invention showing the dome/lens interface with a mitered bend.

The exact shape of concentric conductors 10 and 11 is chosen such that collimated energy entering the invention in the horizontal plane from the far field will be focussed at a point on the feed circle 15 and likewise energy entering the invention from a source on the feed circle 15 will be focussed at the far field. As is shown in FIGS. 2 and 6, a bend or lip such as that shown by number 12 may be formed from inner conductor 11. This bend or lip 12, when designed using standard waveguide practices will redirect energy from the flow direction between conductors 10 and 11 to the flow direction in the flared horn 20 and vice versa with a minimum mismatch loss. The beam orthogonal to the scan plane has been focussed by the invention as a result of installing a lens apparatus which consists of the flared horn 20 and the dielectric 21. However by attaching this lens apparatus, path lengths have been altered and a new dome shape is required in order to retain the theoretically perfect focussing property in the scan plane.

This new dome shape is a full figure of revolution about axis Z and is found by solving an integral equation arising from the focus condition in the scan plane which takes the effects of the lens apparatus 20 and 21 into account. It is thought by those skilled in the art that the electromagnetic energy which traverses the area between conductors 10 and 11 does so along an arithmetic mean surface 14 between these two conductors. It is the shape of this arithmetic mean surface 14 that is found upon solving the integral equation. The distance between conductors 10 and 11 is less than one-half wavelength at the highest frequency of operation but is otherwise chosen for convenience. It is the shape of the arithmetic mean surface 14 which determines whether the geodesic dome/lens antenna will focus in the scan plane.

Figure 4:
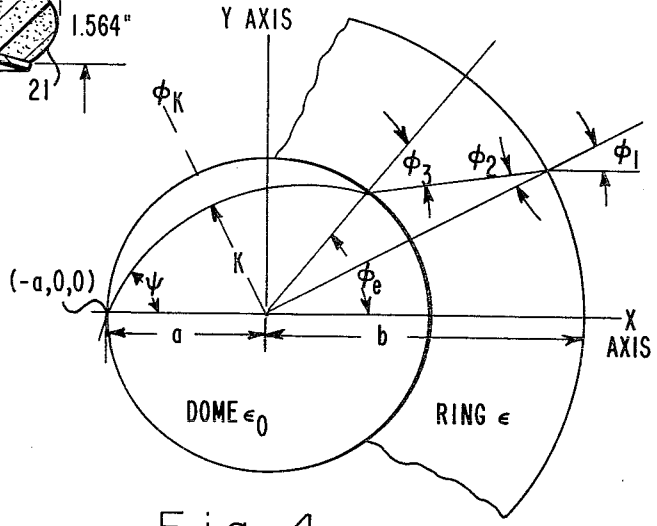
FIG. 4 is a schematic top view showing angles which characterize typical ray paths through the dome and the lens.

All rays which traverse the arithmetic mean dome surface are assumed to do so tangentially to this surface. This surface is considered to be the reference surface for the following descriptions. As shown in FIG. 4, a feed is placed at $\phi=\pi$ and rays emanate at an angle $\psi$ from the feed and tangential to the reference dome surface. A ray traced in the direction of decreasing $\phi$ strikes the feed circle at the exit angle $\phi_e$ as shown in FIG. 4. The path length between the two points is given by the integral:

$$-\int_{\pi}^{\phi_e}\sqrt{(d\rho)^2+(\rho d\phi)^2+(dz)^2} = -\int_{\pi}^{\phi_e}\sqrt{\rho^2+(l'\rho_\phi)^2}\,d\phi \tag{1}$$

where $\rho_\phi = d\rho/d\phi$ along the ray path, and the dome is defined in terms of an arc length l which is a function of $\rho$:

$$(d\rho)^2 + (dz)^2 = (dl)^2 = \left(\frac{dl}{d\rho}\ \frac{d\rho}{d\phi}\ d\phi\right)^2 = (l'\rho_\phi)^2\,(d\phi)^2 \tag{2}$$

where $\rho$ is the distance from the z axis to the arithmetic mean surface. Fermat's principle which is well known to those skilled in the art states that the integral between the two fixed angles $\pi$ and $\phi_e$ is minimum (a geodesic). From the calculus of variations, the integrand I must satisfy Euler's equation which is also well known in the art:

$$\frac{d}{d\phi}\left(\frac{\partial I}{\partial \rho_\phi}\right) = \frac{\partial I}{\partial \rho} \text{ or} \tag{3}$$

$$\rho_\phi \frac{d}{d\rho}\left[\frac{(l')^2\rho_\phi}{I}\right] = \left[\frac{\rho + l'l''\rho_\phi^2}{I}\right] \tag{4}$$

where I is the square root integrand in (1). This is a first order differential equation in the dependent variable $\rho_\phi$ vs. $\rho$ assuming $(\rho)$ is known. To solve it, change the dependent variable as was done in the case of the dielectric Luneberg lens:

$$K=\rho^2/I \tag{5}$$

and write $\rho_\phi$ in terms of $\rho$ and K:

$$\rho_\phi = \pm\frac{\rho}{Kl'}\ \sqrt{\rho^2 - K^2} \tag{6}$$

When this expression is substituted into (4), the differential equation reduces to the simple result:

$$dK/d\rho=0 \tag{7}$$

whose solution is:

$$K=\text{constant} \tag{8}$$

Evidently from (6) the constant K is the value of $\rho$ for which $\rho_\phi=0$ or K is the distance of closest approach of the ray measured from the z axis. Now equation (6) is easily solved for $\rho$ vs. $\phi$. In the first part of the path $\rho_\phi$ is positive; therefore $\phi$ and $\rho$ are related by the integral:

$$\pi - \phi = \int_\rho^a \frac{Kl'(u)\,du}{u\sqrt{u^2 - K^2}} \tag{9}$$

When $\rho$ equals K, take the corresponding angle to be $\phi_K$:

$$\pi - \phi_K = K \int_K^a \frac{l'(u)\,du}{u\sqrt{u^2 - K^2}} \tag{10}$$

Past the point $(K,\phi_k)$, $\phi$ is smaller than $\phi_k$ and, the solution to (6) is:

$$\phi_K - \phi = K \int_K^\rho \frac{l'(u)\,du}{u\sqrt{u^2 - K^2}} \tag{11}$$

Evidently the path is symmetrical about the point of closest approach $(K,\phi_k)$. Further note that:

$$K = \frac{\rho^2}{I} = \rho\cdot\frac{\rho d\phi}{\sqrt{(\rho d\phi)^2 + (dl)^2}} = \rho\cdot\frac{\rho d\phi}{dS} = \rho\sin\theta$$

where $\theta$ is the angle between the ray path and the plane $\phi$=constant. Therefore, not only is the parameter K equal to the distance of closest approach, but it also is related to a particular ray emanating from the feed at an angle $\psi$ as follows:

$$K=\rho\sin\theta=a\sin\psi \tag{12}$$

This ray leaves the dome at the same angle $\psi$. Also from the symmetry of the ray path, the azimuth exit angle $\phi_e$ and the angle $\phi_k$ are related by:

$$\phi e=2\phi k-\pi \tag{13}$$

The foregoing results describe the ray paths and ray properties assuming the dome surface $l(\rho)$ is specified. This surface $l(\rho)$ must be chosen such that when a dielectric lens is attached to the output edge, all output rays in the plane z=0 are focussed.

The exit angle $\phi_e$ must be such that emanating rays in the plane z=0 as shown in FIG. 4 are collimated parallel to the x axis. The angles $\phi_1$, $\phi_2$, $\phi_3$, and $\phi_e$ in the figure are related as follows:

$$K = a\sin\psi = a\,\eta_o\sin\phi_3 \quad \text{(Snell's Law)} \tag{14}$$

$$\frac{b}{\sin(\pi - \phi_3)} = \frac{a}{\sin\phi_2} \quad \text{(Law of Sines)} \tag{15}$$

$$\eta_o\sin\phi_2 = \sin\phi_1 \quad \text{(Snell's Law)} \tag{16}$$

$$\phi_3 - \phi_2 + \phi_1 = \phi_e \quad \text{(Focus Condition)} \tag{17}$$

where $\eta_o$=the refractive index of the dielectric material and is related to $\epsilon$ by $\eta_o^2=\epsilon/\epsilon_o$.

Snell's Law and the Law of Sines are both well known to those skilled in the art. These equations may be solved successively for the angles $\phi_3$, $\phi_2$, and $\phi_1$ in terms of the parameter K:

$$\phi_3=\sin^{-1}(K/a\eta_o) \tag{18}$$

$$\phi_2=\sin^{-1}(K/b\eta_o) \tag{19}$$

$$\phi_1=\sin^{-1}(K/b) \tag{20}$$

Equations (13) and (17) lead to the following relation:

$$\pi-\phi_k=(\pi/2)-(\phi_e/2)=(\pi/2)-\tfrac{1}{2}(\phi_3-\phi_2+\phi_1)$$

The integral equation for the dome shape is obtained by substituting (10) for the left side and (18), (19), (20) for the right side of this equation:

$$\frac{4}{\pi}\int_K^a \frac{Kl'(u)\,du}{u\sqrt{u^2 - K^2}} = \tag{21}$$

-continued $$1+\frac{2}{\pi}\left(\cos^{-1}\frac{K}{b}+\cos^{-1}\frac{K}{a\eta_o}-\cos^{-1}\frac{K}{b\eta_o}\right)=g(K)$$

This is Abel's integral equation for the unknown function $l'(\rho)$ which must be satisfied for all values of K in the range 0 to a. Abel's equation is also well known in the art. The function $l'(\rho)$ uniquely defines the surface since the surface coordinate $Z(\rho)$ is related to $l'(\rho)$ by rearranging (2) and integrating:

$$z(\rho)=\int_{\rho}^{a}\sqrt{l'^2(u)-1}\,du \tag{22}$$

The above equation (22) gives the dome shape, however, $l'$ must first be found.

To solve the integral equation (21) for $l'$, first multiply by $dK/K^2-\rho^2$ and integrate on K between $\rho$ and a. The order of integration in the left member (LM) may be changed as follows:

$$LM=\int_{\rho}^{a}\frac{dK}{\sqrt{K^2-\rho^2}}\cdot\frac{4}{\pi}\int_{K}^{a}\frac{Kl'(u)\,du}{u\sqrt{u^2-K^2}}=$$

$$2\int_{\rho}^{a}\frac{l'(u)\,du}{u}\cdot\frac{2}{\pi}\int_{\rho}^{u}\frac{K\,dK}{\sqrt{(K^2-\rho^2)(u^2-K^2)}}$$

Since the last integral on K is unity, the left member becomes:

$$LM=2\int_{\rho}^{a}\frac{l'(u)\,du}{u} \tag{23}$$

The same process applied to the right member (RM) of (21), g(K), produces the result:

$$RM=\int_{\rho}^{a}\frac{g(K)dK}{\sqrt{K^2-\rho^2}}=g(\rho)\int_{\rho}^{a}\frac{dK}{\sqrt{K^2-\rho^2}}+\int_{\rho}^{a}\frac{[g(K)-g(\rho)]dK}{\sqrt{K^2-\rho^2}}=g(\rho)\cosh^{-1}\frac{a}{\rho}+\int_{\rho}^{a}\frac{[g(K)-g(\rho)]}{\sqrt{K^2-\rho^2}}dK \tag{24}$$

The function $l'(\rho)$ is obtained by equating (23) and (24) and differentiating both sides with respect to $\phi$. After an integration by parts, the result is:

$$2l'(\rho)=\frac{ag(a)}{\sqrt{a^2-\rho^2}}-\int_{\rho}^{a}\frac{Kg'(K)dK}{\sqrt{K^2-\rho^2}}$$

In view of the form of g(K) as given in (21), the remaining integration reduces to three elementary integrations, and the results may be simplified to closed form:

$$2l'(\rho)=\frac{a}{\sqrt{a^2-\rho^2}}+1+q(b,\rho)+q(a\eta_o,\rho)-q(b\eta_o,\rho); \tag{25a}$$

where:

-continued $$q(v,\rho)=\frac{2}{\pi}\left[\frac{a\cos^{-1}\frac{a}{v}}{\sqrt{a^2-\rho^2}}-\cos^{-1}\sqrt{\frac{a^2-\rho^2}{v^2-\rho^2}}\right] \tag{25b}$$

where:

$v=b$ or $a\eta_o$ or $b\eta_o$

The solution for the function $z(\rho)$ is obtained by using (25) for $l'$ in (22). Unfortunately, there generally is no closed form expression for the result and numerical integration is necessary. An exceptional situation arises if either $a=b$ or $n_o=1$, because $2l'$ reduces to the form:

$$2l'=\frac{a}{\sqrt{a^2-\rho^2}}+1 \tag{26}$$

and Rinehart's result is recovered.

The above derivation of the exact shape of the arithmetic mean surface succeeds in focussing energy in the scan plane. As is shown, the size of the flared horn 20 is considered. The flared horn 20 is a circularly symmetrical E-plane horn. A beamwidth $\Delta\theta$ in the plane orthogonal to the scan plane requires an aperture size of about $\lambda/\Delta\theta$, and to have a path length error of less than $\lambda/4$, the horn length L must satisfy the condition:

$$L\geqq\frac{\lambda}{L(\Delta\theta)^2}$$

For many applications, the horn length would be larger than the radius of the dome and the volume of the antenna would become very large. This aperture efficiency problem can be improved by filling the horn with a dielectric lens 21 in an effort to collimate the rays approximately parallel to the plane of scan. The shape of the dielectric at the dielectric/air interface is chosen to focus the rays in the plane orthogonal to the scan plane. Filling the flared horn with a dielectric 21 results in a smaller size horn 20. As can be seen by referring to FIG. 6, the dielectric substance has the general shape of a pie shaped wedge.

Figure 5:
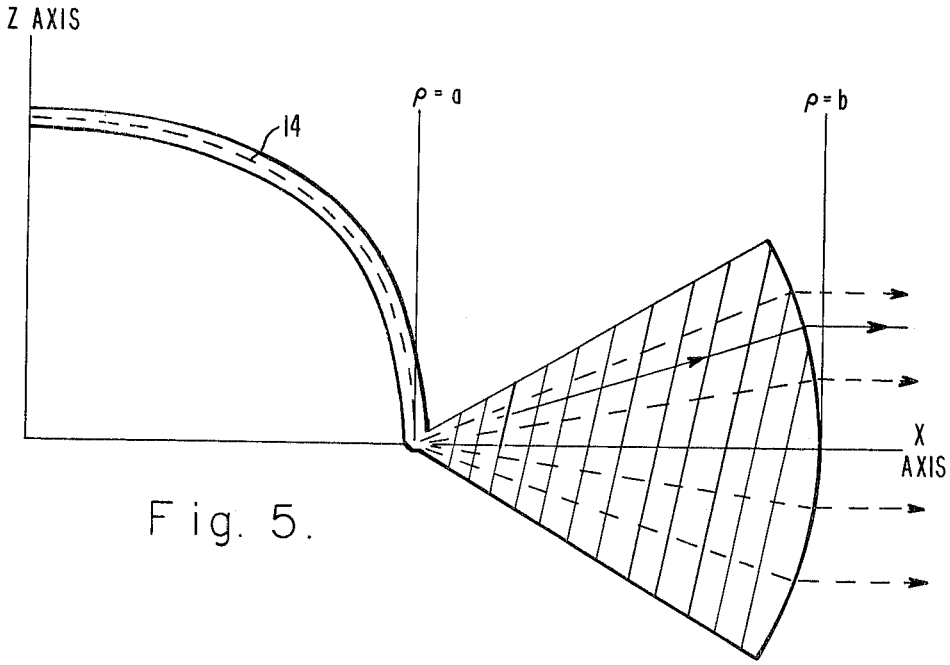
FIG. 5 is a schematic view showing rays emanating from the dome periphery being focussed in elevation by the lens.

The lens shape 21 is designed such that with a feed at (−a,0,0) see FIG. 4, all rays emanating from the lens surface in the plane $y=0$ are focussed at infinity. This requires the optical path between the output of the dome ($\rho=a$) and the interface $\rho=b$ to be constant for any ray as is shown in FIG. 5:

$$\eta_o\sqrt{(\rho-a)^2+z^2}+(b-\rho)=\text{constant}=\eta_o(b-a) \tag{27}$$

This relation for the lens surface may be rearranged into a form which is readily recognized as an ellipse:

$$\left[\rho-\frac{b+\eta_o a}{1+\eta_o}\right]^2+\frac{\eta_o^2z^2}{\eta_o^2-1}=\frac{\eta_o^2(b-a)^2}{(\eta_o+1)^2} \tag{28}$$

Thus to find $\rho$, rearrange (28):

$$\rho = \sqrt{\frac{\eta_o^2(b-a)^2}{(\eta_o+1)^2} - \frac{\eta_o^2 Z^2}{\eta_o^2 - 1}} + \frac{b + \eta_o a}{1 + \eta_o}$$

where $\rho$=the distance from the Z axis to the outer curvature of dielectric substance 21.

Thus combining this specific lens shape with the specific arithmetic mean surface shape derived previously (equations (25*a*), (25*b*) and 22)), the invention focusses energy in both the scan plane and the orthogonal plane. The dome-shaped mean surface 14 and lens apparatus 20 and 21 work in conjunction to provide high directivity, narrow beamwidths and low sidelobes.

As can be seen by referring to FIG. 2 and FIG. 6, bend 12 redirects energy which strikes its surface. In the preferred embodiment of the invention, a standard waveguide miter is used. This device is well known in the art and functions efficiently in the preferred embodiment where the spacing between the two dome-shaped conductors 10 and 11 is less than $\lambda/2$. It is to be noted that although the preferred embodiment uses a miter device, there are other devices and methods well known in the art which accomplish the result of the miter. The invention is not restricted to using a miter device. One purpose of this device is to present a matched interface to incident energy. Thus, standard waveguide design practices are employed in matching this interface to achieve maximum power transfer.

Figure 3:
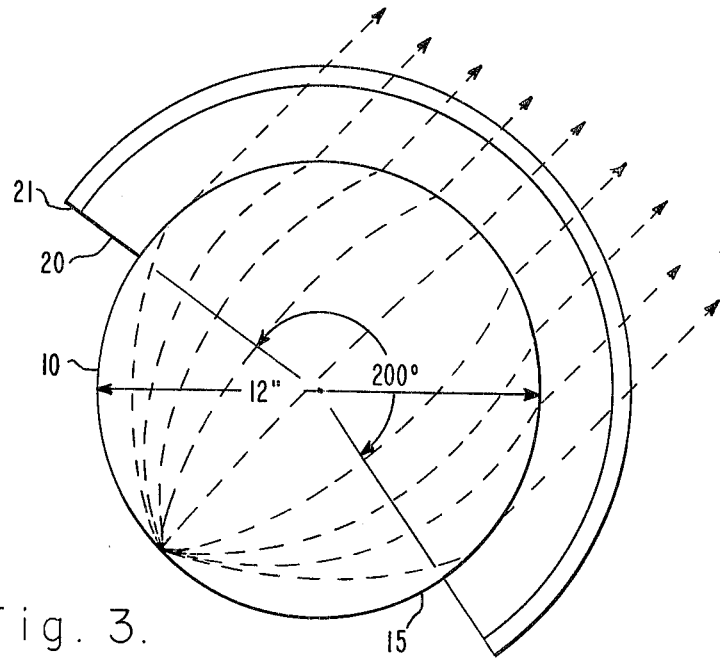
FIG. 3 is a top view of an embodiment of the subject invention and depicts the propagation of energy transmitted through the structure from a source located on the feed circle.

Because of the circular symmetry of the invention, the radiated beam shape is independent of the scan angle and a wide scan sector is achieved. In an experimental embodiment as shown in FIG. 3, a scan sector of approximately 20° (±10°) is achieved. In order to achieve this, the flared horn is attached to the feed circle for 200°. The remaining area of the feed circle may be connected to a means for feeding energy into and out of the invention. Although this experimental embodiment has a scan angle of approximately 20°, the invention is not limited to that particular amount. The flared horn may cover more or less of the feed circle however it should be noted that if the flared horn covers more than 270° of the feed circle in the preferred embodiment, the exit aperture may interfere with the entrance aperture depending upon how much of the feed circle is to be used for the entrance aperture. This problem however may be cured by another embodiment of the invention. By installing an appropriate device such as a three port circulator between the geodesic dome structure and the lens apparatus, interference between the entrance aperture and the exit aperture is eliminated.

The invention possess good aperture efficiency since the width of the optical beam in the scan plane equals the diameter of the dome-shaped mean surface. The invention maintains this efficiency for all scan angles due to the symmetry of the structure.

As can be seen from FIG. 1 and FIG. 2, feed horns 13 may be installed along the feed circle. The feed circle may be connected to waveguide sections which in turn may be connected to separate receiver and processing equipment. Thus the whole field of view of the antenna may be monitored without a scanning action. Should an object which enters that field of view be detected, the relative position of that object can be determined by comparing the energy outputs of the different waveguide feed horns connected to the feed circle. In a radar application, each feed horn may be switched from transmit to receive in a predetermined sequence, thus providing the beam agility, accuracy, and consistency required to track many targets with high sensitivity and high resolution.

The preferred embodiment shows waveguide feeds 13, however, it is to be understood that other feed means well known in the art may be used. For example, in some applications, coaxial line feeds may be used. Furthermore, it is to be understood that the invention may be used either for transmission or reception of energy. Descriptions contained herein which indicate the antenna's use in one mode are not to be construed that the antenna is operable in only that mode. The description used is only for convenience in specifying the operation of the invention.

Employing the invention as a transmitter of energy to the far field, energy will enter the geodesic dome arithmetic mean surface 14 at the feed circle 15 through a feed transmission means such as a waveguide 13. Upon entering, the energy will propagate along the airthmetic mean surface 14 between the two dome-shaped parallel conductors 10 and 11 in accordance with Fermat's theory of geodesics. Due to the unique shape of the arithmetic geodesic mean surface, the energy will exit the domes 10 and 11 along the diametrically opposed feed circle. This energy enters the dielectric 21 inside the flared horn 20. Upon leaving the dielectric, the energy is focussed in both azimuth and elevation.

In the preferred embodiment, the space between conductors 10 and 11 is filled with air. The invention is not limited to air and other dielectric substances may be substituted. Also in the preferred embodiment, a low loss homogeneous foam such as quartz foam is used for dielectric 21. It is to be understood that different substances may be substituted for the foam. However, due to the preferred embodiment's use of low loss foam in the flared horn and air between conductors 10 and 11, high efficiency and low loss is maintained. Furthermore, this low internal loss and use of optical techniques permits antenna operation in the millimeter wavelength region.

In fabricating the two dome-shaped conductors 10 and 11, standard techniques such as spinning, turning, stamping, electro-forming, etc., from sheet aluminum, block stock or other substances may be used. Tolerances may be loose since the system is unconstrained. Due to the small number of parts and loose tolerances, assembly is simple and insensitive to error. Since common manufacturing techniques and low cost materials are used, and since the dome is a full figure of revolution, the antenna system disclosed here has a low total cost and is mechanically stronger than prior art systems.

Using the principles, formulas and other information disclosed above, an antenna was designed and operated in the $K_A$ band. A separation of 0.070 inch was maintained between conductors 10 and 11. The lens apparatus 20 and 21 extended around feed circle 15 for 200°, see FIGS. 2 and 3.

The geodesic dome conductors 10 and 11 were constructed by machining the outer and inner domes from bulk aluminum stocks. A tracer lathe was employed to machine the dome sections and the flared sections that form the radiating aperture of the lens. Tracer templates were fabricated and employed in the machining process which accurately described the dome contour and the details of the bend and horn flare 20 for each dome. Machining the domes and horn flares from bulk stocks was a key construction process in this embodiment since it eliminated the inaccuracies and uncertainties of non-contacting surfaces that result when numerous independently fabricated parts are assembled and attached by mechanical fasteners.

Construction of the dielectric lens 21 aperture which mates with the flared horn 20 was also based on machining from bulk dielectric stock. A low loss quartz foam, Eccofoam QG, which has a dielectric constant of 1.4 and dissipation factor less than 0.001 was used for the lens construction. This material has excellent mechanical properties that are ideal for machining to close tolerances. The annular section to cover 200° the radiation periphery was achieved by machining three annular sectors of approximately the same arc lengths.

The integrated assembly of the domes 10 and 11 and the dielectric loaded horn 20 is shown in FIGS. 2 and 3. A seven-element feed consisting of reduced height WR28 waveguides was used at the feed circle. The feed waveguides have a reduced height of 0.070 inch in order to transition directly into the feed periphery of the dome which has a fixed spacing of 0.070 inch between conductors 10 and 11.

Experimental evaluation of the $K_A$-band dome and dielectric lens antenna was conducted in the 26.5 to 40 GHz range which is compatible with the operating band of WR28 waveguide. The initial series of tests was concerned with the focussing of the WR28 reduced height feed. Various feed positions were evaluated employing spacers between the feed and dome flanges. The gain, sidelobe and nulling properties in the secondary patterns were assessed as a function of the different feed positions. The optimum feed position in this embodiment was found to be with the waveguide aperture shimmed to 0.004 inch below the plane of the feed circle.

Single beam patterns of a single feed element were measured for the focussed condition in the E- and H-planes of the antenna over the 26.5 to 40 GHz band. The H-plane patterns reflected a small unbalance in the principal sidelobes which is attributed to irregularities related to manufacturing errors in the dome and lens sections of the antenna. The uniformity of the pattern formation as a function of scan was investigated by measuring the H-plane patterns of five neighboring beams. Although variations in the principal sidelobes were observed, the other pattern properties for gain and beamwidth remain unvarying. The varying sidelobe level as a function of feed scan angle was observed and is related to the antenna irregularities discussed above. The measured beamwidths at 40 GHz were 10.7 degrees and 1.7 degrees for the E- and H-planes, respectively as compared to 10.8 and 1.4 degrees predicted for the antenna.

The measured gain for the geodesic dome and lens configuration was typically about 30.5 dB. The gain varied from 29.3 dB at 26.5 GHz to 31.4 dB at 40 GHz. Comparison of the measured gain against the antenna directivity derived from the measured beamwidth, shows that the efficiency of the antenna varies between 60 and 72 percent. The high efficiency is due to the quasi-uniform aperture illuminations that are obtained with this embodiment when fed by an open-end waveguide feed.

Feeding techniques for modifying the aperture illumination for low H-plane sidelobes were also investigated. By employing H-plane flared feeds larger than the 0.280 inch aperture of WR28 waveguide, an improvement in sidelobe performance was observed. Sidelobes better than 20 dB were observed over the 26.5 to 40 GHz band. However, as expected, a corresponding increase in beamwidth and a gain reduction of about 1.5 dB were noted.

There has been described and shown a new and useful geodesic dome/lens antenna which fulfills the aforementioned objects of the invention. The foregoing description and drawings are intended to illustrate one particular embodiment of the invention. It will be obvious to those persons skilled in the art that other embodiments and variations to the disclosed embodiment exist but do not depart from the principles and scope of the invention.

What is claimed is:

1. An antenna for providing a substantially collimated beam, comprising:

(a) a geodesic lens antenna having two concentric surfaces of revolution about a central axis (b) feed means for feeding energy into and out of the area between the surfaces of revolution;

(c) an annular flared horn having a first annular conductor coupled to one concentric surface at the periphery thereof and having a second annular conductor coupled to the second concentric surface at the periphery thereof, the annular conductors disposed at a predetermined angle to each other;

(d) an annular dielectric lens disposed between the annular conductors and having, in a plane parallel with the central axis, a cross-sectional shape of a wedge with the tip of the wedge facing towards the central axis, and having an outer surface facing away from the central axis; and (e) the geodesic lens antenna further being shaped to compensate for the presence of the annular dielectric lens to maintain the collimation of energy which propagates from the feed means through the geodesic lens antenna and through the dielectric lens, in a plane perpendicular to the central axis;

(f) whereby the beam is substantially collimated in two perpendicular planes.

2. The structure of claim 2 wherein:

(a) the two concentric surfaces are separated from each other by a distance that is less than one-half wavelength at the highest frequency of operation;

(b) whereby the TEM mode may exist between the two concentric surfaces.

3. The structure of claim 1 wherein the geodesic lens antenna is a full figure of revolution about the central axis.

4. The structure of claim 1 wherein the shape of the energy transmission path through the geodesic lens antenna is in accordance with:

$$z(\rho) = \int_{\rho}^{a} \sqrt{l'^2(u) - 1}\, du;$$

where:

$$l'(\rho) = \frac{\dfrac{a}{\sqrt{a^2 - \rho^2}} + 1 + q(b,\rho) + q(a\eta_o,\rho) - q(b\eta_o,\rho)}{2};$$

where:

-continued $$q(v,\rho) = \frac{2}{\pi}\left[\frac{a\cos^{-1}\frac{a}{v}}{\sqrt{a^2-\rho^2}} - \cos^{-1}\sqrt{\frac{a^2-\rho^2}{v^2-\rho^2}}\right];$$

where $v = b$ or $a\eta_o$ or $b\eta_o$ where:

$z(\rho)$ = surface of revolution about the central axis through the geodesic lens antenna $\eta_o$ = refractive index of the dielectric lens a = radius of the geodesic lens antenna periphery b = radius of the antenna including the dielectric lens $\eta$ = distance from the central axis to the surface of revolution of the energy transmission path through the geodesic lens antenna.

5. The structure of claim 1 wherein the dielectric lens has a cross sectional shape in accordance $$\rho = \sqrt{\frac{\eta_o^2(b-a)^2}{(\eta_o+1)^2} - \frac{\eta_o^2 Z^2}{\eta_o^2-1}} + \frac{b+\eta_o a}{1+\eta_o}$$

where:

$\eta$ = distance from the central axis of the geodesic lens antenna to the outer outer surface of the dielectric lens $\eta_o$ = refractive index of the dielectric lens a = radius of the geodesic lens antenna b = radius of the antenna including the dielectric lens Z = the distance to the outer surface of the dielectric lens from a line bisecting the dielectric lens.

6. The structure of claim 1 wherein the dielectric lens has a refractive index of less than 1.

7. The antenna of claim 1 wherein the cross-sectional shape of the outer surface of the dielectric lens is elliptical.

8. An antenna for providing a substantially collimated beam comprising:

(a) a geodesic lens antenna having two concentric surfaces of revolution about a central axis;

(b) lens means coupled to the geodesic lens antenna for refracting energy along a predetermined length of the periphery of the concentric surfaces to form a collimated beam in a plane parallel to the central axis, the lens means comprising an annular flared horn having a first annular conductor coupled to one of the concentric surfaces at the periphery thereof and having a second annular conductor coupled to the second concentric surface at the periphery thereof, the annular conductors disposed at a predetermined angle to each other, and the lens means further comprising an annular dielectric lens disposed between the annular conductors and, in a plane parallel with the central axis, having a cross-sectional shape of a wedge with the tip of the wedge facing towards the central axis and having an outer surface facing away from the central axis; and (c) the geodesic lens antenna further being shaped such that it compensates for the refraction by the lens means to maintain collimation of the beam in a plane perpendicular to the central axis;

whereby a beam is provided which is substantially collimated in two perpendicular planes.

9. The antenna of claim 8 wherein the shape of the outer surface of the dielectric lens is elliptical.

10. An antenna for providing a substantially collimated beam, comprising:

(a) an annular dielectric lens apparatus comprising an annular flared horn having two annular conductors disposed at a predetermined angle to each other and an annular dielectric lens disposed between the annular conductors and having a cross-sectional shape of a wedge with the tip of the wedge facing the direction of convergence of the annular conductors, and having an outer surface opposite the tip, shaped for collimating a beam in the plane of the cross-section; and (b) a geodesic lens antenna having two concentric conductors which are surfaces of revolution about a central axis coupled at their peripheries to respective annular conductors such that the wedge shaped cross-section of the dielectric lens is in a plane parallel to the central axis, the geodesic lens antenna further being shaped to compensate for the presence of the annular dielectric lens apparatus to maintain collimation of the energy which propagates through the geodesic lens antenna and the lens apparatus from a point on the periphery of the geodesic lens antenna in a plane perpendicular to the central axis;

whereby the beam is substantially collimated in two perpendicular planes.

11. The antenna of claim 10 wherein the cross-sectional shape of the outer surface of the dielectric lens is elliptical.

* * * * *

UNITED STATES PATENT AND TRADEMARK OFFICE

CERTIFICATE OF CORRECTION

PATENT NO. : 4,488,156

DATED : December 11, 1984

INVENTOR(S) : EDWARD C. DU FORT ET AL.

It is certified that error appears in the above—identified patent and that said Letters Patent is hereby corrected as shown below:

On the title page;

In the Abstract, line 3, delete "base" and substitute --beam--.

Column 7, line 24, delete "(ρ)" and substitute --ℓ(ρ)--.

Column 9, line 52, delete "ϕ" and substitute --ρ--.

In the Claims:

Column 14, line 44, delete "claim 2" and substitute --claim 1--.

Column 15, line 13, delete "periphery".

Column 15, line 15, delete "η" and substitute --ρ--.

Column 15, line 27, delete "η" and substitute --ρ--.

Signed and Sealed this

Thirtieth Day of July 1985

[SEAL]

*Attest:*

DONALD J. QUIGG

*Attesting Officer* *Acting Commissioner of Patents and Trademarks*